US009557042B2

(12) United States Patent
Motoike

(10) Patent No.: US 9,557,042 B2
(45) Date of Patent: Jan. 31, 2017

(54) LED ILLUMINATION SYSTEM HAVING A PLURALITY OF ALTERABLE LIGHT SOURCE ELEMENTS

(71) Applicant: USHIO DENKI KABUSHIKI KAISHA, Tokyo (JP)

(72) Inventor: Tatsuya Motoike, Kanzaki-gun (JP)

(73) Assignee: USHIO DENKI KABUSHIKI KAISHA, Tokyo (JP)

( * ) Notice: Subject to any disclaimer, the term of this patent is extended or adjusted under 35 U.S.C. 154(b) by 107 days.

(21) Appl. No.: 14/533,275

(22) Filed: Nov. 5, 2014

(65) Prior Publication Data

US 2015/0131279 A1 May 14, 2015

(30) Foreign Application Priority Data

Nov. 13, 2013 (JP) ..... 2013-235065

(51) Int. Cl.

| | |
|---|---|
| ***F21V 1/00*** | (2006.01) |
| ***F21V 23/02*** | (2006.01) |
| *F21V 19/00* | (2006.01) |
| *H01R 13/639* | (2006.01) |
| *H01R 33/06* | (2006.01) |
| *H01R 33/94* | (2006.01) |
| *F21Y 101/00* | (2016.01) |

(52) U.S. Cl.

CPC ..... *F21V 23/02* (2013.01); *F21S 4/10* (2016.01); *F21V 19/0005* (2013.01); *F21Y 2101/00* (2013.01); *H01R 13/639* (2013.01); *H01R 33/06* (2013.01); *H01R 33/94* (2013.01)

(58) Field of Classification Search

CPC ..... F21V 23/02; F21V 19/0005; F21S 4/10; H01R 13/639; H01R 33/06; H01R 33/94

USPC ..... 362/235

See application file for complete search history.

(56) References Cited

U.S. PATENT DOCUMENTS 5,941,626 A 8/1999 Yamuro
2011/0273102 A1* 11/2011 van de Ven ..... H05B 33/0809 315/193

FOREIGN PATENT DOCUMENTS

JP H10-021707 A 1/1998

* cited by examiner

*Primary Examiner* — Anh Mai
*Assistant Examiner* — Hana Featherly
(74) *Attorney, Agent, or Firm* — Studebaker & Brackett PC

(57) ABSTRACT

An illumination system includes an illumination base. The illumination base has two common lines, a plurality of parallel branching lines extending between the common lines respectively, and a plurality of sockets disposed on the branching lines. The same number of sockets are disposed on each branching line, and the sockets are connected in series. The illumination system also includes light source elements. Each light source element has a first plug portion to be received in one of the sockets, and an LED lamp to be electrically connected to the illumination base when the first plug portion is received in the associated socket. The illumination system also includes resistor elements. Each resistor element has a second plug portion to be received in one of the sockets, and a resistor to be electrically connected to the illumination base when the second plug portion is received in the associated socket.

13 Claims, 13 Drawing Sheets

LED ILLUMINATION SYSTEM HAVING A PLURALITY OF ALTERABLE LIGHT SOURCE ELEMENTS

FIELD OF THE INVENTION

The present invention relates to an improvement to an illumination system that includes a plurality of LED lamps.

DESCRIPTION OF THE RELATED ART

An example of luminous apparatus (light-emitting apparatus, or illumination systems) that has an elongated shape and includes a plurality of luminous units (light-emitting units) is disclosed in Japanese Patent Application Laid-Open Publication No. Hei 10-021707 (Patent Literature 1). The luminous units include a plurality of LED lamps (bulbs) or light source elements electrically connected in series. The "LED" stands for light-emitting diode.

The luminous apparatus of Patent Literature 1 includes a circuit that has the luminous units. The luminous units are connected in parallel to each other, and each of the luminous units has a plurality of light source elements connected in series. Resistor elements are provided in the circuit.

In general, this type of illumination system needs to include the same luminous units having the same light source elements in order to cause all the light source elements to emit the light at the same luminance. Specifically, the number of the light source elements in the respective luminous units is the same, and the kind of the light source elements is the same. The luminous units may have different light source elements and/or different resistor elements in terms of the number and kind. However, the illumination system having such luminous units may only be employed for a special purpose, and not suitable for general purpose.

Even if all the luminous units have the same light source elements in terms of the number and the kind, it is often difficult to keep the luminance of the light source elements at the same level because there are some irregularities in the LED forward voltage (individual differences among the light source elements).

LISTING OF REFERENCE(S)

Patent Literature(s)

PATENT LITERATURE 1: Japanese Patent Application Laid-Open Publication No. Hei 10-021707

SUMMARY OF THE INVENTION

One object of the present invention is to provide an LED illumination system that can have a desired number of light source elements at desired positions, and that can allow the change in the number and/or positions of the light source elements in a desired and proper manner.

In order to achieve the above-mentioned object, one aspect of the present invention provides an illumination system that includes an LED circuit assembly having an illumination base. The illumination base includes a pair of common lines, and a plurality of branching lines extending between the pair of common lines respectively. The branching lines are parallel to each other. Each of the branching lines is formed by a same number (predetermined number) of sockets connected in series. The sockets are divided into a first group of sockets and a second group of sockets. The illumination system also includes a plurality of light source elements. Each light source element has a first plug portion to be received in one socket in the first group of sockets, and also has an LED lamp to become part of the LED circuit assembly when the first plug portion is received in the associated socket. The illumination system also includes a plurality of resistor elements. Each resistor element has a second plug portion to be received in one socket in the second group of sockets, and also has a resistor to become part of the LED circuit assembly when the second plug portion is received in the associated socket.

With the above-described LED illumination system, it is possible to easily and properly decide (change) the number and positions of the light source elements to be disposed on each branching line of the illumination base in a desired manner. Therefore, it is possible to customize the entire LED illumination system in terms of the number and arrangement of the light source elements as desired. The resistors may have different resistance values. With the resistor elements having such resistors, it is also possible to customize the LED illumination system in terms of the luminance of the light source elements depending upon the resistor elements to be used.

According to another aspect of the present invention, there is provided an LED illumination system that includes an illumination base. The illumination base has a pair of common lines, a plurality of parallel branching lines extending between the two common lines respectively, and a plurality of sockets disposed on the branching lines such that a same number of sockets are disposed on each branching line and connected in series. The sockets are divided into a first group of sockets and a second group of sockets. Each of the sockets in the first group has the same configuration as each of the sockets in the second group. The illumination system also includes a plurality of light source elements. Each of the light source elements has a first plug portion to be received in one of the sockets in the first group, and also has an LED lamp to be electrically connected to the illumination base when the first plug portion is received in the associated socket. The illumination system also includes a plurality of resistor elements. Each of the resistor elements has a second plug portion to be received in one of the sockets in the second group, and also has a resistor to be electrically connected to the illumination base when the second plug portion is received in the associated socket. The illumination base may be referred to as an LED circuit assembly of the illumination system.

The present invention enables the LED illumination system to have a desired number of light source elements at desired positions. In addition, it is possible to alter the number and positions of the light source elements under given conditions. The present invention may be useful for the illumination system at an event, meeting or other function that requires a customized illumination because the present invention can easily and properly prepare the customized illumination.

These and other objects, aspects and advantages of the present invention will become apparent to a skilled person from the following detailed description when read and understood in conjunction with the appended claims and drawings.

DETAILED DESCRIPTION OF THE INVENTION

An exemplary embodiment of the present invention will be described with reference to FIG. 1 to FIG. 14 of the accompanying drawings.

FIG. 1 to FIG. 4 illustrate an LED lamp 1 according to the embodiment of the present invention. The LED lamp 1 is a shell-like LED lamp. The LED lamp 1 can emit light toward its optical axis X and can also efficiently expand (spread) the light in a predetermined angular range, with the optical axis X being the center. In other words, the LED lamp 1 has a wide directivity.

Figure 5:
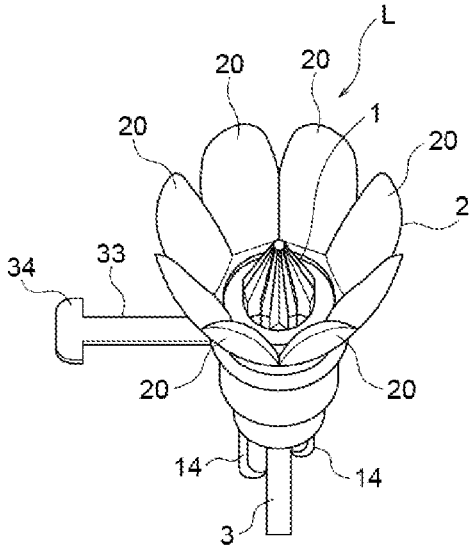
FIG. 5 is a perspective view of a decorative light source element according to the embodiment of the present invention that includes the LED lamp of FIG. 1.

FIG. 5 illustrates a light source element L for decorative illumination. The light source element L has the LED lamp 1 and a reflector member 2, and is shaped like a flower. The LED lamp 1 may be referred to as a flower center, and the reflector member 2 may be referred to as a combination of petals around the flower center. Because the LED lamp 1 of the light source element L has the wide directivity (can emit light in a spreading angle), the LED lamp 1 efficiently emits the light toward the reflector member 2 surrounding the LED lamp 1. As the reflector member 2 is irradiated with the light from the LED lamp 1, the light source element L illuminates (shines, becomes luminous) as a whole. The light source element L has a plug portion 3 at its bottom.

Figures 13A, 13B:
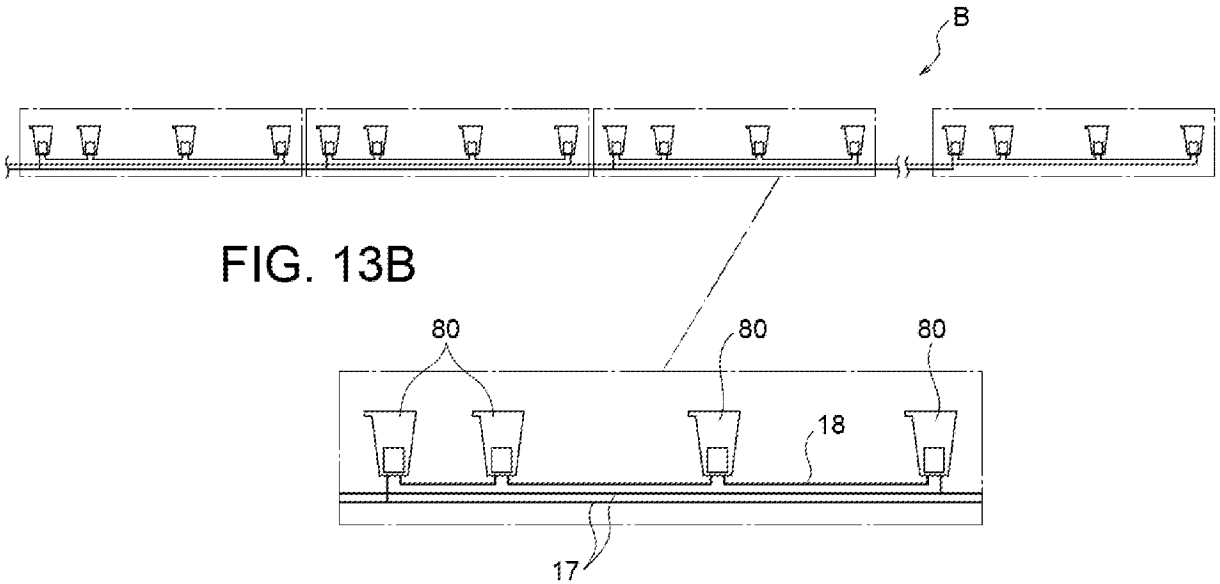
FIG. 13A is a side view of a major part of the illumination base of the illumination system.
FIG. 13B is an enlarged view of part of FIG. 13A.

FIG. 13A shows an illumination base B of an LED illumination system that has a plurality of sockets 80. The sockets 80 are arranged at predetermined positions. Each of the sockets 80 has a shape that corresponds to the plug portion 3 of the light source element L. In this LED illumination system, a plurality of light source elements L are disposed at selected (desired) ones of the sockets 80. The plug portions 3 of the light source elements L are received in the predetermined sockets 80 of the illumination base B. Plug portions 4 of resistor elements R (will be described) are received in the remaining sockets 80. As such, the LED illumination system has a desired number of light source elements L at desired positions. It should be noted that the number and the positions of the light source elements L can be altered as desired.

LED Lamp 1

As depicted in FIG. 1 to FIG. 4, the LED lamp 1 has an LED 12 (FIG. 4) and a sealing resin 10 for the LED 12. The sealing resin 10 has a plurality of (or at least two) grooves 10*a* in its outer surface around the optical axis X of the LED lamp 1. The grooves 10*a* are spaced from each other in the circumferential direction of the LED lamp 1 at predetermined intervals. Each groove 10*a* has a generally "V" cross-sectional shape when groove 10*a* is cut in the direction perpendicular to the optical axis X. Each groove 10*a* generally extends along the optical axis X.

Figure 4:
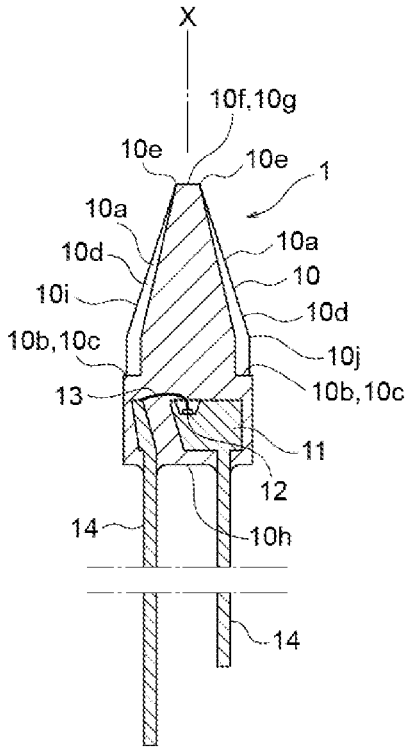
FIG. 4 is a cross-sectional view of the LED lamp taken along the line IV-IV in FIG. 2.

As shown in FIG. 4, the LED lamp 1 also has a lead frame 11, a wire 13, and a pair of leads 14. The LED 12 is provided in the form of chip in this embodiment. The sealing resin 10 is made from a plastic material which is transparent or translucent. When the sealing resin 10 is fabricated, the lead frame 11 is placed in a mold and a synthetic resin is poured into the mold. The synthetic resin becomes the plastic. Typically, the sealing resin 10 has an upper end 10*f* and a lower end 10*h*. The LED 12 is situated below the upper end 10*f*. The lower end 10*h* is situated below the lead frame 11. The upper end 10*f* may be referred to as a front end, and the lower end 10*h* may be referred to as a rear end. The lateral portion 10*i* of the sealing resin 10 has a generally circular cross-sectional shape when viewed in the cross section in the direction perpendicular to the optical axis X of the LED lamp 1 at any location of the optical axis X. The optical axis X is always the center of this circular cross-sectional shape. The sealing resin 10 has the same (constant) outer diameter from the lower end 10*h* to a predetermined height position 10*j* (approximate half the entire height of the sealing resin 10). The outer diameter of the sealing resin 10 gradually decreases from the predetermined height position 10*j* toward the upper end 10*f*. The predetermined height position 10*j* is higher than the position of the LED 12.

Figure 1:
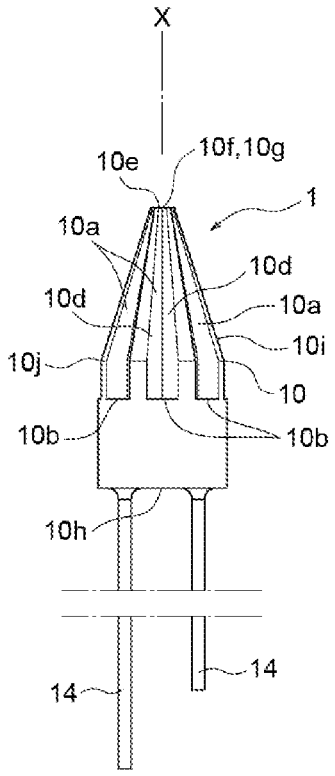
FIG. 1 is a side view of an LED lamp according to one embodiment of the present invention, with some portions of leads being omitted.
Figure 2:
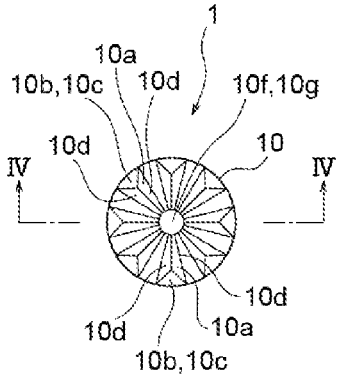
FIG. 2 is a plan view of the LED lamp shown in FIG. 1.
Figure 3:
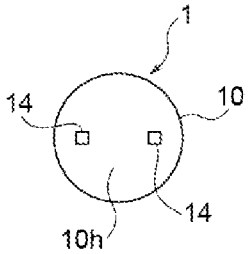
FIG. 3 is a bottom view of the LED lamp shown in FIG. 1.

Each of the grooves 10*a* extends upwards from its start position 10*b* to the upper end 10*f* of the sealing resin 10. Thus, the lower end of each groove 10*a* is the groove start position 10*b*, and the upper end 10*e* of the groove 10*a* is the upper end 10*f* of the sealing resin 10. The start position 10*b* is higher the position of the LED 12. In the illustrated embodiment, the start position 10*b* of each groove 10*a* is lower than the predetermined height position 10*j*. As mentioned above, the predetermined height position 10*ji* is the position at which the outer diameter of the sealing resin 10 starts decreasing. As shown in FIGS. 2 and 4, the lower end 10*b* of each groove 10*a* is defined by a flat portion 10*c* which extends in a hypothetical plane extending in the direction perpendicular to the optical axis X. In the illustrated embodiment, each groove 10*a* has right and left side walls 10*d* and 10*d*, and the right and left side walls 10*d* and 10*d* meet at the groove bottom. The flat portion 10*c* of the groove 10*a* has a generally isosceles triangle shape when viewed from the upper end 10*f* of the sealing resin 10. As shown in FIG. 2, the base of this triangle is defined by the outer circumference of the sealing resin 10, and the bottom of the groove 10*a* is that peak of the triangle which faces the base of the triangle. In the illustrated embodiment, each groove 10*a* becomes shallower as the groove 10*a* approaches the upper end 10*f* of the sealing resin 10. The upper end 10*e* of each groove 10*a* is open. In the illustrated embodiment, the sealing resin 10 has eight grooves 10*a*. These grooves 10*a* are spaced from each other in the circumferential direction of the sealing resin 10 at equal intervals, as shown in FIG. 2.

The upper end 10*f* of the sealing resin 10 is defined by a flat portion 10*g*, which extends in a hypothetical plane extending in the direction perpendicular to the optical axis X of the LED lamp 1.

As understood from FIGS. 2 and 4, the light emitted from the LED 12 proceeds in the direction of the optical axis X when the light passes through those sections (non-groove sections) of the lateral portion 10*i* of the sealing resin 10 which are situated between each two adjacent grooves 10*a*. On the other hand, the remaining light among the light emitted from the LED 12 passes through those sections (groove sections) of the lateral portion 10*i* of the sealing resin 10 which situated in the grooves 10*a*, and therefore the side walls 10*d* of the grooves 10*a* cause such light to proceed in the direction crossing the optical axis X of the LED lamp 1. As a result, the LED lamp 1 of this embodiment has the light spreading function.

Because the upper end 10*f* of the sealing resin 10 is the flat portion 10*g*, the light emitted from the LED 12 creates a high luminous (optical) intensity area along (on) the optical axis X.

Because the lower end 10*b* of each of the grooves 10*a* in the sealing resin 10 is also the flat portion 10*c*, the light emitted from the LED 12 creates a plurality of (eight) high luminous intensity areas at the respective lower ends 10*b* of the eight grooves 10*a*.

In the illustrated embodiment, when the LED lamp 1 is viewed from the top (FIG. 2), there is a high luminous intensity area (first high luminous intensity area) at the position of the optical axis X and a plurality of another high luminous intensity areas (second high luminous intensity areas) at the lower ends 10*b* (10*c*) of the grooves 10*a* around the first high luminous intensity area (around the optical axis X). The second high luminous intensity areas are present at equal intervals in the circumferential direction of the sealing resin 10.

Figure 14:
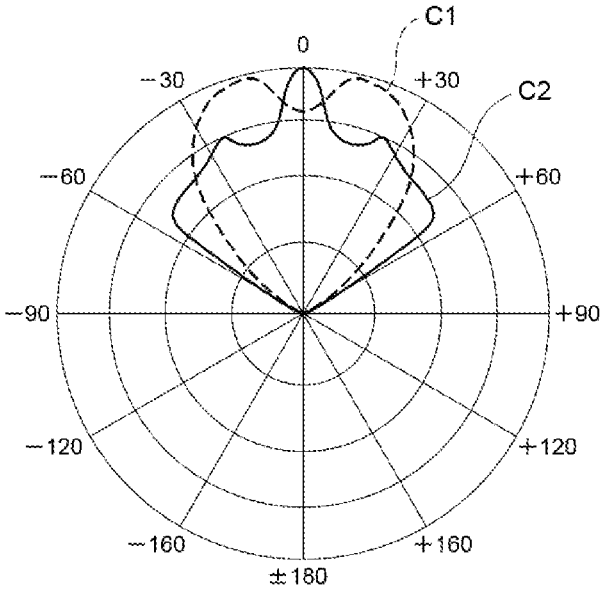
FIG. 14 shows two luminous intensity curves of different LED lamps.

If the grooves 10*a* are not formed in the sealing resin 10 and the upper end 10*f* is sharp, the luminous intensity distribution of the LED lamp 1 draws a curve C1 which is indicated by the broken line in FIG. 14. FIG. 14 shows the luminous intensity at the respective angles from 0 degree to −180 degrees and from 0 degree to +180 degrees. As understood from FIG. 14, the luminous intensity C1 of the LED lamp 1 becomes relatively weak (low) at the optical axis X (0 degree) position, and the light spreads in a range between about −45 degrees and about +45 degrees, with the optical axis X being included.

When the grooves 10*a* are formed in the sealing resin 10 as described above, and the upper end 10*f* has the flat portion 10*g* as described above, then the luminous intensity distribution of the LED lamp 1 draws a curve C2 as indicated by the solid line in FIG. 14. The luminous intensity C2 becomes strong (high) at the optical axis X (0 degree) position, and the light spreads in a range between about −60 degrees and about +60 degrees, with the optical axis X being included.

Light Source Element L

Figure 6:
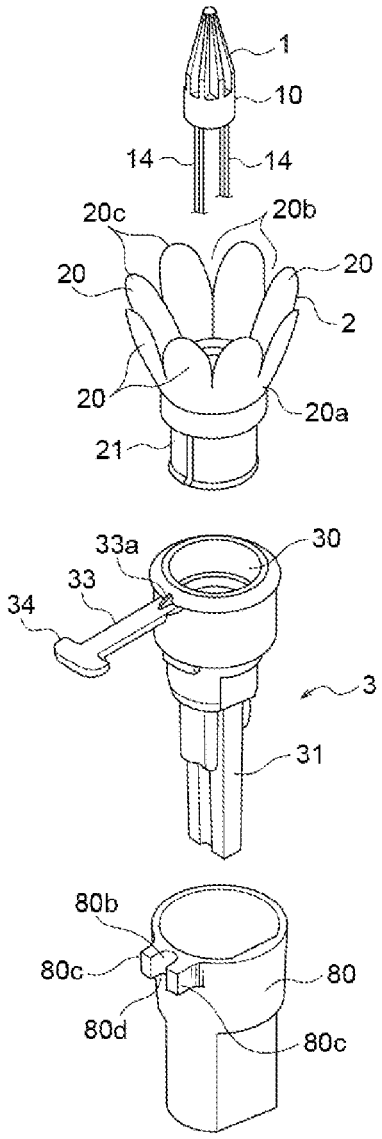
FIG. 6 is an exploded view of the light source element shown in FIG. 5, together with a socket of an illumination base of the illumination system.

As shown in FIG. 5, the light source element L has the LED lamp 1 at its center, and a plurality of reflector pieces 20 around the LED lamp 1. The reflector pieces 20 are shaped like petals. The reflector pieces 20 extend upward and diagonally outward from a single (common) base portion 20*a* (FIG. 6). Thus, the diameter defined by the upper ends of the reflector pieces 20 is larger than the diameter defined by the base portion 20*a*. In other words, the reflector pieces 20 form a generally cylindrical shape having a gradually increasing diameter from the base portion 20*a*.

In the illustrated embodiment, the light source element L includes the LED lamp 1, a reflector unit 2, and a plug portion 3.

As shown in FIG. 6, the reflector unit 2 has a cylindrical foot 21. The foot 21 has opening at its upper and lower ends. The reflector unit 2 is integral with the foot 21. The base portion 20*a* of the reflector pieces 20 is joined to the upper end of the cylindrical foot 21. In this embodiment, each two adjacent reflector pieces 20 are connected to each other at the base portion 20*a*, but they are separated from each other at their upper portions, with spacing or gaps 20*b* being defined between each two adjacent reflector pieces 20. The upper end (edge) 20*c* of each reflector piece 20 has an arc shape. Thus, each reflector piece 20 has a petal shape.

The LED lamp 1 has a pair of leads 14 that extend downward from the lower end of the foot 21 when the sealing resin 10 of the LED lamp 1 is placed in the reflector unit 2 (when the LED lamp 1 is fitted in the reflector unit 2).

In this embodiment, the reflector unit 2 and the foot 21 have a function to reflect the light emitted from the LED 12, and a function to transmit the light therethrough. The reflector unit 2 and the foot 21 are made from plastic and fabricated by a molding process.

Figure 7:
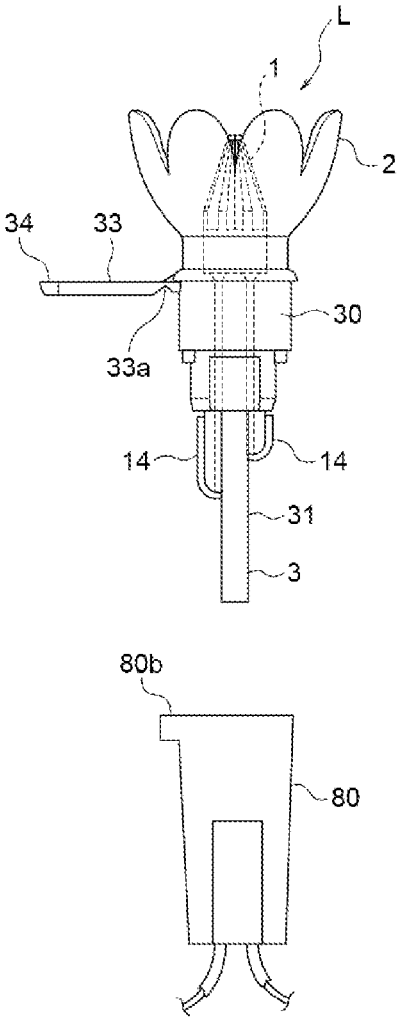
FIG. 7 is a side view showing the light source element and the socket separated from the light source element.

The plug portion 3 has a receiving part 30 to receive the cylindrical foot 21, and an insertion part 31 to be received in the socket 80 (will be described). The insertion part 31 has two through holes 32 (FIG. 9) extending downward from a lower end of the receiving part 30. After the LED lamp 1 is received in the reflector unit 2, the foot 21 of the reflector unit 2 is inserted in the receiving part 30, with the leads 14 of the LED lamp 1 being the firstly inserted element. Then, the two leads 14 extend through the two through holes 32 of the insertion part 31, respectively, and protrude downward from the insertion part 31 of the plug portion 3. As shown in FIG. 7, the leads 14 are bent upward (toward the receiving part 30). Thus, the leads 14 unite the plug portion 3 with the reflector unit 2 and the LED lamp 1.

As illustrated in FIG. 6, a strip-like (band-shaped) piece 33 is connected, at one end thereof, to the inlet of the receiving part 30 of the plug portion 3 via a hinge 33*a*. The hinge 33*a* is made from a resin material. The opposite end of the band-shaped piece 33 has a T head 34, which is an engagement part. In this embodiment, one of the two leads 14 (anode lead or a cathode lead) is situated below the band-shaped piece 33 (FIG. 7). The socket 80 has a receiving part 80*b* at its upper end (in the vicinity of its upper opening). When the plug portion 3 of the light source element L is received in the socket 80 and the engagement part 34 of the band-shaped piece 33 is received (engaged) in the receiving part 80*b* of the socket 80, then the LED lamp 1 is electrically connected to the LED circuit assembly or an illumination base of the illumination system (will be described later).

LED Illumination System

Figure 12:
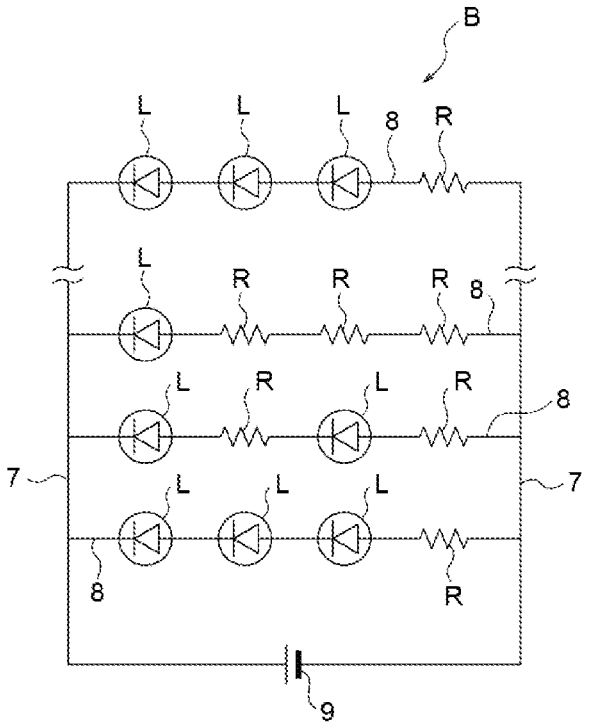
FIG. 12 illustrates a configuration of an LED circuit assembly of the illumination system.

Referring to FIGS. 12, 13A and 13B, the LED illumination system includes the illumination base B, a plurality of light source elements L, and a plurality of resistor elements R.

The illumination base B has a pair of common lines 7 and 7, and a plurality of branching lines 8 spanning the common lines 7 and 7. Each of the branching lines 8 is defined by a plurality of sockets 80 connected in series. The branching lines 8 extend in parallel to each other, and therefore the illumination system has a parallel LED circuit assembly.

Each branching line 8 has the same number of sockets 80. As understood from FIG. 12 and FIG. 13B, each branching line 8 (18) has four sockets 80.

An exemplary configuration of the LED circuit assembly is shown in FIG. 12. The LED circuit assembly has a power supply 9. It should be noted that the number of the branching lines 8 may be decided (or altered) based on given conditions. Each branching line 8 has at least one resistor element R. In the illustrated embodiment, each branching line 8 has four sockets 80 (not shown in FIG. 12) as mentioned above.

An exemplary configuration of the illumination base B is illustrated in FIGS. 13A and 13B. FIG. 13B shows one branching line. In this drawing, a reference numeral 17 designates the wiring of the common lines 7, and a reference numeral 18 designates the wiring of the branching lines 8. The sockets 80 are connected to the wirings 17 and 18. The illumination base B has an elongated shape, including the wirings 17, 18 and the sockets 80. The illumination base B may be installed in various ways. For example, the illumination base B may be suspended from or on a wall, may be put like a bridge, or may be wound around something.

Figure 8:
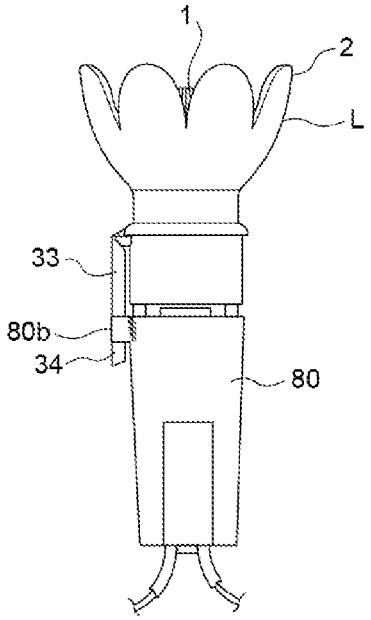
FIG. 8 is a side view showing the light source element and the socket when a plug portion of the light source element is received in the socket.
Figure 9:
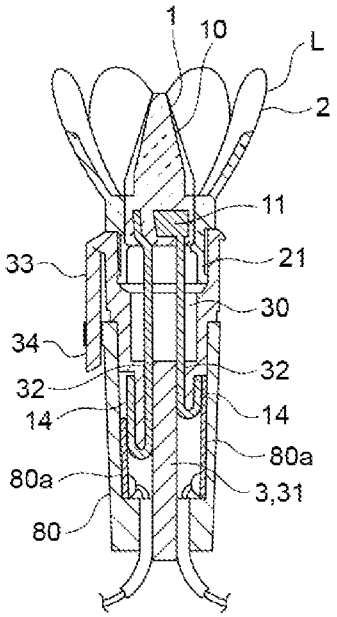
FIG. 9 is a vertical cross-sectional view of the light source element and the socket shown in FIG. 8.

As shown in FIG. 6, the socket 80 has a cup shape to receive the plug portion 3 of the light source element L. The socket 80 has a terminal 80*a* (not shown in FIG. 6 but shown in FIG. 9) on its inner wall. The terminal 80*a* is part of the wiring 18 of the branching line 8 of the LED circuit assembly. The socket 80 has the receiving portion 80*b* on its outer wall in the vicinity of the upper opening thereof (opening to receive the plug portion 3). The engagement portion (T head) 34 of the plug portion 3 engages with the receiving portion 80*b* of the socket 80. In the illustrated embodiment, the receiving portion 80*b* includes a groove 80*d* that has a size allowing the band-shaped piece 33 of the plug portion 3 to move therethrough but not allowing the T head 34 of the plug portion 3 to move therethrough. The receiving portion 80*b* has a pair of ribs 80*c* and 80*c* to define the groove 80*d* therebetween. The plug portion 3 of the light source element L is inserted in the socket 80 until the bottom of the receiving part 30 of the plug portion 3 is properly received in the socket 80. After the plug portion 3 of the light source element L is completely fitted in the socket 80, the resin-made hinge 33*a* is bent such that the band-shaped piece 33 pivots about the hinge 33*a* and the free end (T head) of the band-shaped piece 33 approaches the side wall of the plug portion 3. Then, the band-shaped piece 33 is received in the groove 80*d*, and the T head 34 are situated below the ribs 80*c* and 80*c*, as shown in FIG. 8. The T head 34 hook at the lower faces of the ribs 80*c*. Accordingly, the light source element L is securely coupled with the socket 80, and this coupling is maintained stably. When the plug portion 3 of the light source element L is completely inserted in the socket 80, the inner terminal 80*a* of the socket 80 contacts the leads 14 of the light source element L, and is electrically connected to the leads 14 (FIG. 9). As a result, the LED lamp 1 of the light source element L becomes part of the LED circuit assembly.

It should be noted that the sockets 80 on each branching line 8 may be spaced from each other at equal intervals, or at different interval.

Figure 10:
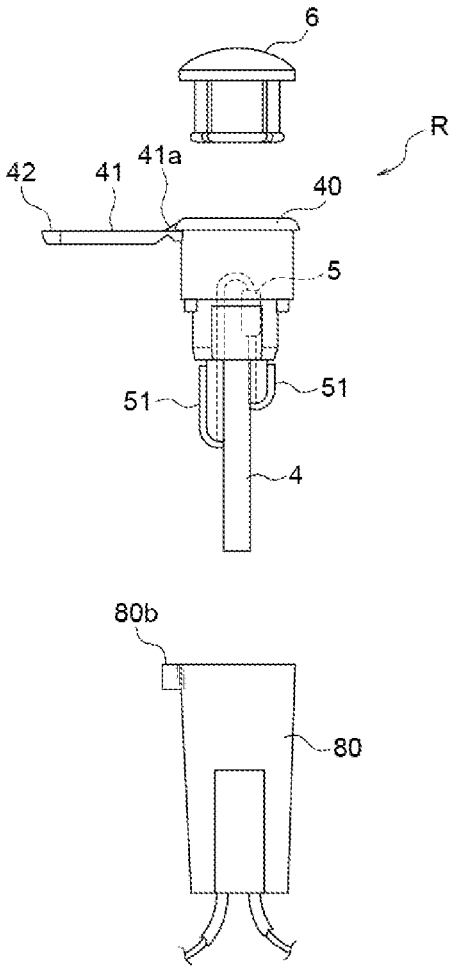
FIG. 10 is an exploded view of a resistor element of the illumination system according to the embodiment of the present invention, together with a socket of the illumination base of the illumination system.

Referring now to FIG. 10, the resistor element R has a plug portion 4, and a resistor 5 that becomes part of the LED circuit assembly when the plug portion 4 is inserted in the associated socket 80 of the LED circuit assembly. In the illustrated embodiment, the plug portion 4 of the resistor element R is substantially the same as the plug portion 3 of the light source element L. The resistor 5 is embedded in the plug portion 4. The resistor element R has a T head (engagement part) 42 that engages with the receiving port 80*b* of the socket 80. The T head 42 is connected to the upper opening of the receiving part 40 of the plug portion 4 by a strip element (band-shaped piece) 41 and a hinge 41*a*. The upper opening of the receiving part 40 of the plug 4 is closed by a cap 6. A pair of leads 51 are electrically connected to the resistor 5. The leads 51 protrude downward from the receiving portion 40 of the plug portion 4 in a similar manner to the leads 14 of the light source element L shown in FIG. 7. The leads 51 are bent upward. The hinge 41*a* is made from a resin material.

Figure 11:
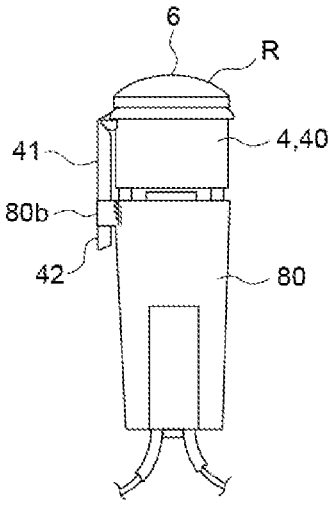
FIG. 11 is a side view of the resistor element and the socket when a plug portion of the resistor element is received in the socket.

After the plug portion 4 of the resistor element R is completely fitted in the socket 80, the resin-made hinge 41*a* is bent such that the band-shaped piece 41 pivots about the hinge 41*a* and the free end (T head) 42 of the band-shaped piece 41 approaches the side wall of the plug portion 4. Then, the band-shaped piece 41 is received in the receiving portion 80*b* of the socket 80, and the T head 42 are situated below the receiving portion 80*b*, as shown in FIG. 11. The T head 42 hook at the lower faces of the receiving portion 80*b*. Accordingly, the resistor element R is securely coupled with the socket 80, and this coupling is maintained stably. When the plug portion 4 of the resistor element R is completely received in the associated socket 80, the inner terminal 80*a* of the socket 80 contacts the leads 51 of the resistor element R and is electrically connected to the leads 51. As a result, the resistor 5 of the resistor element R becomes part of the LED circuit assembly.

With the LED illumination system having the above-described structure, it is possible to easily and properly decide and change the number and the arrangement of the light source elements L to be disposed on each of the branching lines 8 under given conditions. Thus, customization of the LED illumination system is easy with respect to the number and the positions of the light source elements L.

It should be noted that the resistors 5 of the resistor elements R provided in the LED illumination system (FIG. 12) may have the same resistance value or different resistance values. If the resistor elements R have the resistors 5 with different resistance values, the customization of the LED illumination system becomes also possible with respect to the luminance by selecting (using) the resistor elements R which have the desired resistance values.

In the example shown in FIG. 12, when the branching line 8 uses three light source elements L, the branching line 8 has a single resistor element R (top and bottom branching lines 8 in FIG. 12). When the branching line uses two light source elements L, the branching line has two resistor elements R (third branching line from the top). When the branching line uses one light source element L, the branching line has three resistor elements R (second branching line from the top).

In the example shown in FIG. 12, the power source 9 is, for example, 12V and the LED lamp 1 (VF=2.0 V) is operated, for example, at 15 mA. Then, the number of necessary resistor elements R and the resistance values of the resistors 5 are decided in the following manner.

(1) When three light source elements L are disposed on each branching line 8, one resistor element R is disposed. The resistance value of the resistor element R is calculated by the equation below, and becomes 400Ω (ohms).

$$R=(12(V)-2.00(V)\times 3)/0.015=400\ \Omega$$

(2) When two light source elements L are disposed, two resistor elements R are disposed. The sum of the resistance values of the two resistor elements R is calculated by the equation below, and becomes 533Ω (ohms).

$$R_{total}=(12-2\times 2)/0.015=533\ \Omega$$

(3) When one light source element L is disposed, three resistor elements R are disposed. The sum of the resistance values of the three resistor elements R is calculated by the equation below, and becomes 666Ω (ohms).

$$R_{total}=(12-2\times1)/0.015=666\ \Omega$$

While a certain embodiment has been described, the embodiment has been presented by way of example only, and is not intended to limit the scope of the present invention. The novel apparatuses described herein may be embodied in a variety of other forms; furthermore, various omissions, substitutions and changes in the form of the apparatuses described herein may be made without departing from the gist of the present invention. The appended claims and their equivalents are intended to cover such forms or modifications as would fall within the scope and gist of the present invention.

It should be noted that the terms "upper," "lower," "below," "above," "right," "left," "front," "rear," and the like are used in the foregoing description, but these terms are only used to facilitate the understanding to the illustrated embodiment and are not intended to limit the scope of the invention.

The present application is based upon and claims the benefit of a priority from Japanese Patent Application No. 2013-235065, filed Nov. 13, 2013, and the entire content of which is incorporated herein by reference.

What is claimed is:

1. An illumination system comprising:

an LED circuit assembly having an illumination base, said illumination base including:

a pair of common lines; and a plurality of branching lines extending between the pair of common lines respectively, the plurality of branching lines being parallel to each other, each of the plurality of branching lines being formed by a same number of sockets connected in series, said plurality of sockets being divided into a first group of sockets and a second group of sockets;

a plurality of light source elements, each said light source element having a first plug portion to be received in one of said sockets in said first group and also having an LED lamp a part of the LED circuit assembly; the first plug portion is received in said one of said sockets in said first group; and a plurality of resistor elements, each said resistor element having a second plug portion to be received in one of said sockets in said second group and also having a resistor a part of the LED circuit assembly; the second plug portion is received in said one of said sockets in said second group.

2. The illumination system according to claim 1, wherein the resistors in the plurality of resistor elements have a same resistance value.

3. The illumination system according to claim 1, wherein the resistors in the plurality of resistor elements have different resistance values.

4. The illumination system according to claim 1, wherein the sockets of each said branching line are spaced from each other at equal intervals.

5. The illumination system according to claim 1, wherein the sockets of each said branching line are spaced from each other at different intervals.

6. The illumination system according to claim 1, wherein each said LED lamp has a reflector unit to reflect light emitted from the LED lamp concerned.

7. The illumination system according to claim 1, wherein each of the sockets in said first group has a same configuration as each of the sockets in said second group.

8. An illumination system comprising:

an illumination base including:

a pair of common lines;

a plurality of branching lines extending between the pair of common lines respectively, the plurality of branching lines being parallel to each other; and a plurality of sockets disposed on the plurality of branching lines such that a same number of sockets are disposed on each said branching line and connected in series, said plurality of sockets being divided into a first group of sockets and a second group of sockets, the first group of sockets having a same configuration as the second group of sockets;

a plurality of light source elements, each said light source element having a first plug portion to be received in one of said sockets in said first group and also having an LED lamp electrically connected to the illumination base, the first plug portion is received in said one of said sockets in said first group; and a plurality of resistor elements, each said resistor element having a second plug portion to be received in one of said sockets in said second group and also having a resistor electrically connected to the illumination base; the second plug portion is received in said one of said sockets in said second group.

9. The illumination system according to claim 8, wherein the resistors in the plurality of resistor elements have a same resistance value.

10. The illumination system according to claim 8, wherein the resistors in the plurality of resistor elements have different resistance values.

11. The illumination system according to claim 8, wherein the sockets on each said branching line are spaced from each other at equal intervals.

12. The illumination system according to claim 8, wherein the sockets on each said branching line are spaced from each other at different intervals.

13. The illumination system according to claim 8, wherein each said LED lamp has a reflector unit to reflect light emitted from the LED lamp concerned.

* * * * *